US010442099B2

(12) United States Patent
Vorhees et al.

(10) Patent No.: US 10,442,099 B2
(45) Date of Patent: Oct. 15, 2019

(54) SYSTEMS AND METHODS FOR PERFORMING A FULL CUT AND A PARTIAL CUT OF PAPER

(71) Applicant: Toshiba Global Commerce Solutions Holdings Corporation, Tokyo (JP)

(72) Inventors: Kevin Vorhees, Raleigh, NC (US); Richard Harris, Raleigh, NC (US)

(73) Assignee: Toshiba Global Commerce Solutions Holdings Corporation, Tokyo (JP)

( * ) Notice: Subject to any disclaimer, the term of this patent is extended or adjusted under 35 U.S.C. 154(b) by 266 days.

(21) Appl. No.: 15/347,825

(22) Filed: Nov. 10, 2016

(65) Prior Publication Data

US 2018/0126577 A1 May 10, 2018

(51) Int. Cl.

| | |
|---|---|
| ***B26D 1/06*** | (2006.01) |
| ***B41J 11/70*** | (2006.01) |
| ***B26D 5/16*** | (2006.01) |
| ***B26D 3/12*** | (2006.01) |
| ***B26D 5/00*** | (2006.01) |

(52) U.S. Cl.

CPC ..... *B26D 1/065* (2013.01); *B26D 3/12* (2013.01); *B26D 5/005* (2013.01); *B26D 5/16* (2013.01); *B41J 11/70* (2013.01)

(58) Field of Classification Search

CPC ..... B26D 1/065; B26D 3/12; B26D 5/005; B26D 5/16; B41J 11/70

See application file for complete search history.

(56) References Cited

U.S. PATENT DOCUMENTS

| | | | | |
|---|---|---|---|---|
| 6,109,154 | A * | 8/2000 | Miyatsu | B26D 1/085 83/202 |
| 6,347,896 | B1 | 2/2002 | Robinson | |
| 6,405,625 | B1 * | 6/2002 | Nomura | B41J 15/042 83/618 |
| 8,573,871 | B2 | 11/2013 | Hanaoka et al. | |
| 8,690,463 | B2 | 4/2014 | Myers | |
| 2007/0296799 | A1 * | 12/2007 | Watanabe | B26F 1/18 347/222 |
| 2016/0229076 | A1 * | 8/2016 | Link | B26D 1/025 |

FOREIGN PATENT DOCUMENTS

DE 4315507 C1 12/1994

* cited by examiner

*Primary Examiner* — Omar Flores Sanchez
(74) *Attorney, Agent, or Firm* — Olive Law Group, PLLC

(57) ABSTRACT

System and methods for performing a full cut and a partial cut of paper are disclosed herein. According to an aspect, a system comprises a paper cutter system comprising a motor operable to move in either a first direction or a second direction. The paper cutter system also comprises a movable blade. The paper cutter system also comprises a cutter mechanism configured to move the blade to perform a full cut of paper when the motor moves in the first direction and move the blade to perform a partial cut of paper when the motor moves in the second direction.

10 Claims, 8 Drawing Sheets

SYSTEMS AND METHODS FOR PERFORMING A FULL CUT AND A PARTIAL CUT OF PAPER

TECHNICAL FIELD

The presently disclosed subject matter relates to paper cutting systems and methods. More particularly, the presently disclosed subject matter relates to paper cutting systems and methods for performing full and partial cuts of paper.

BACKGROUND

Point-of-sale (POS) printers are commonly used to print two types of documents: those requiring a partial cut and those requiring a full cut. A partial cut, which is traditionally used for sales receipts, cuts only part of the width of the paper, leaving a small connecting length. This technique is used so that documents do not fall from the printer after they are cut. A full cut however, traditionally used for coupons, cuts across the entire width of the paper, leaving a smooth edge along the entire bottom. This method allows documents to be neatly stacked after exiting the printer.

Prior solutions have provided POS printers with the ability to perform both a partial cut and a full cut, but have required manual intervention to change the cutter setting. For example, one solution allows a user to vary the cut length by stopping a rotary wheel in different positions. Another solution allows a user to position a guillotine blade in one position to produce a partial cut or another position to produce a full cut. Yet another solution allows a user to move a stationary scissor cutter mounted on a blade carrier to different cutting positions. However, these previous solutions have required either multiple cutting mechanisms or manual intervention to change the cutter setting. Such requirements can ultimately require more of the user's time, resulting in more mistakes, and resulting in increased user effort. In addition, some previous solutions require the cutting mechanism to cycle through a shifting process for each cut, causing excess wear and noise.

For at least the aforementioned reasons, there is a need for improved systems and techniques for allowing a POS printer to conveniently perform both full and partial cuts with the same mechanism, without a need for manual intervention, and to reduce wear and noise in the printer.

SUMMARY

The present disclosure describes a system and method for performing a full cut and a partial cut of paper in accordance with embodiments of the present disclosure. According to an aspect, a system comprises a paper cutter system comprising a motor operable to move in either a first direction or a second direction. The paper cutter system also comprises a movable blade. The paper cutter system also comprises a cutter mechanism configured to move the blade to perform a full cut of paper when the motor moves in the first direction and move the blade to perform a partial cut of paper when the motor moves in the second direction.

According to another aspect, the method of the present disclosure includes determining whether a motor is moving in either a first direction or a second direction. The method may also include moving the blade to perform a full cut of paper in response to determining that the motor is moving in the first direction. Further, the method may include moving the blade to perform a partial cut of paper in response to determining that the motor is moving in the second direction.

BRIEF DESCRIPTION OF THE DRAWINGS

The foregoing summary, as well as the following detailed description of various embodiments, is better understood when read in conjunction with the drawings provided herein. For the purposes of illustration, there is shown in the drawings exemplary embodiments; however, the presently disclosed subject matter is not limited to the specific methods and instrumentalities disclosed.

DETAILED DESCRIPTION

The presently disclosed subject matter is described with specificity to meet statutory requirements. However, the description itself is not intended to limit the scope of this patent. Rather, the inventors have contemplated that the claimed subject matter might also be embodied in other ways, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

Articles "a" and "an" are used herein to refer to one or to more than one (i.e. at least one) of the grammatical object of the article. By way of example, "an element" means at least one element and can include more than one element.

In this disclosure, "comprises," "comprising," "containing" and "having" the like can have the meaning ascribed to them in U.S. patent law and can mean "includes," "including," and the like; "consisting essentially of" or "consists essentially" likewise has the meaning ascribed in U.S. patent law and the term is open-ended, allowing for the presence of more than that which is recited so long as basic or novel characteristics of that which is recited is not changed by the presence of more than that which is recited, but excludes prior art embodiments.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 40, 41, 42, 43, 44, 45, 46, 47, 48, 49, or 50.

Unless specifically stated or obvious from context, as used herein, the term "about" is understood as within a range of normal tolerance in the art, for example within 2 standard deviations of the mean. About can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

Unless otherwise defined, all technical terms used herein have the same meaning as commonly understood by one of ordinary skill in the art to which this disclosure belongs.

Figure 1:
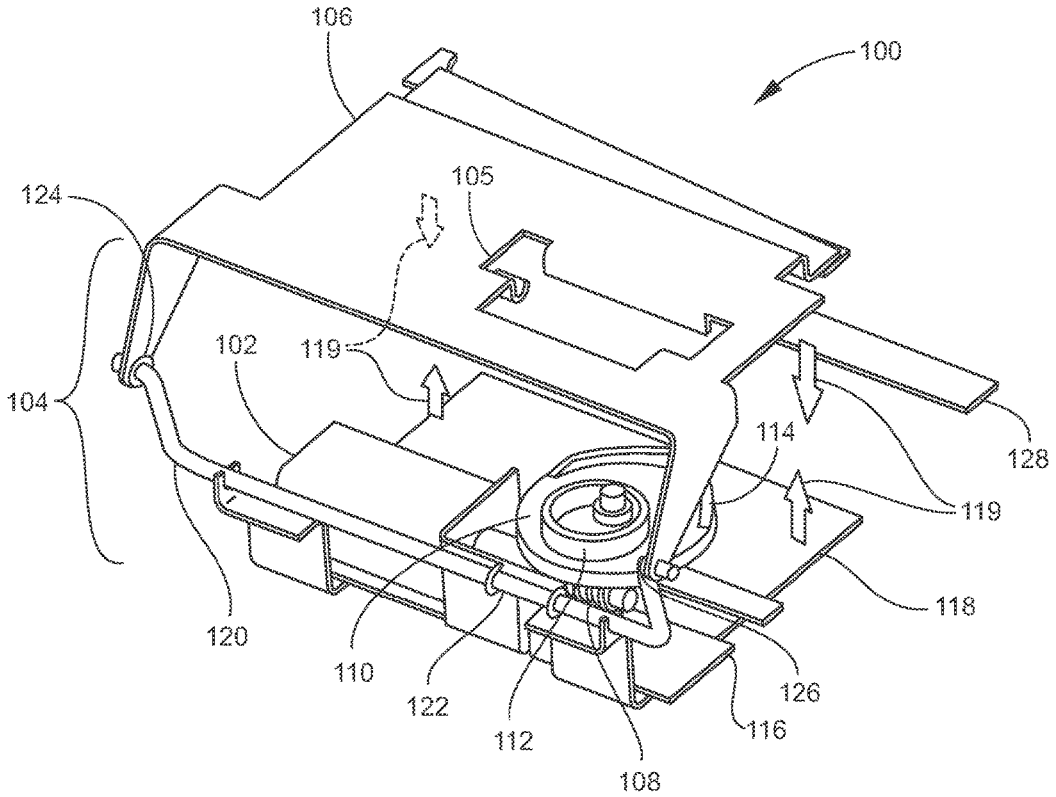
FIG. 1 illustrates a top perspective view of an example paper cutting system in accordance with embodiments of the present disclosure.

Disclosed herein are systems and methods for performing full and partial cuts of paper in accordance with embodiments of the present disclosure. An example paper cutter system may include a motor operable to move in either a first direction or a second direction. For example, FIG. 1 illustrates an example paper cutting system 100 including a motor 102 operable to move in different directions in accordance with embodiments. It should be noted that the top perspective view of the example paper cutting system 100 is shown expanded for clarity. The system 100 may include a POS printer configured to print and cut paper such as, but not limited to, purchase receipts, paper coupons, and the like. In examples, the motor may be a direct current (DC) motor, a stepper motor, or the like. The paper cutting system may also include a movable blade and cutter mechanism. In accordance with embodiments, the cutter mechanism can be configured to move the blade to perform a full cut of paper when the motor moves in one direction, or to perform a partial cut of paper when the motor moves in another direction. For example, the system 100 includes a cutter mechanism 104 and movable blade 106 for implementing this functionality. In this example, cutter mechanism 104 is configured to move blade 106 to perform a full cut of paper when the motor moves in one direction. Also in this example, cutter mechanism 104 is configured to move blade 106 to perform a partial cut of paper when the motor moves in another direction.

The cutter mechanism 104 includes a worm gear 108 configured to be driven by motor 102. Further, the cutter mechanism 104 may include a cam 110 configured to be engaged by worm gear 108. In accordance with embodiments, the cam may include two different profiles: one profile 112 may drive the blade 106; and another profile 114 may be configured to separate the blade 106 from a stationary blade 128. In accordance with embodiments, the profile 114 may be configured to engage blade 106 to separate blades 106 and 128 on a return. In an example, a profile 112 shown in FIG. 1 may drive the blade 106 to meet stationary blade 128 to either fully or partially cut paper.

Figure 2:
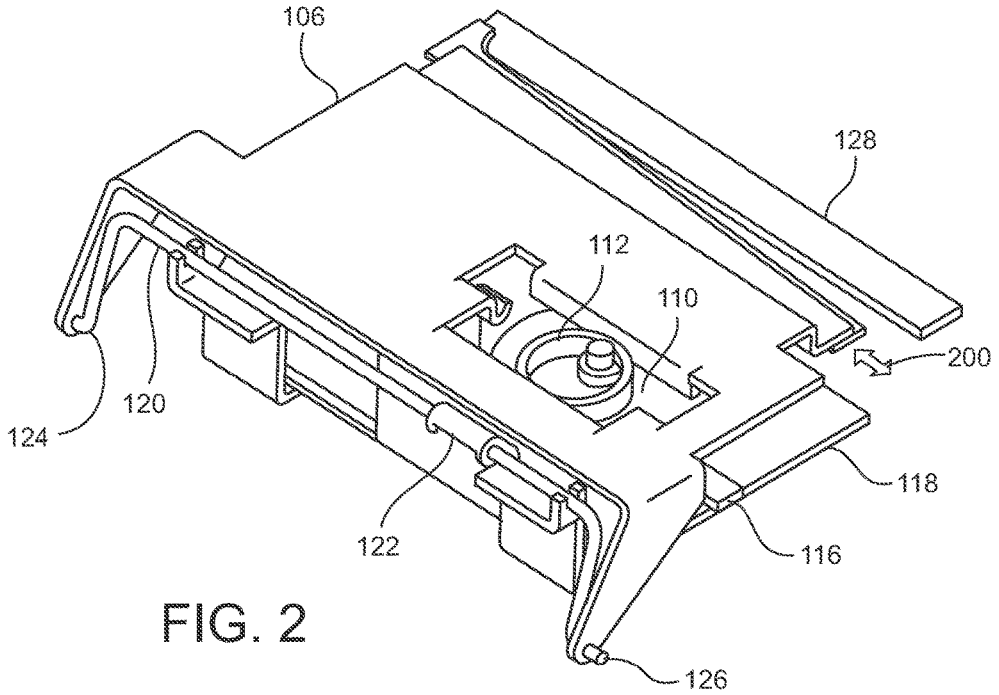
FIG. 2 illustrates a side view of the paper cutting system shown in FIG. 1.
Figure 3:
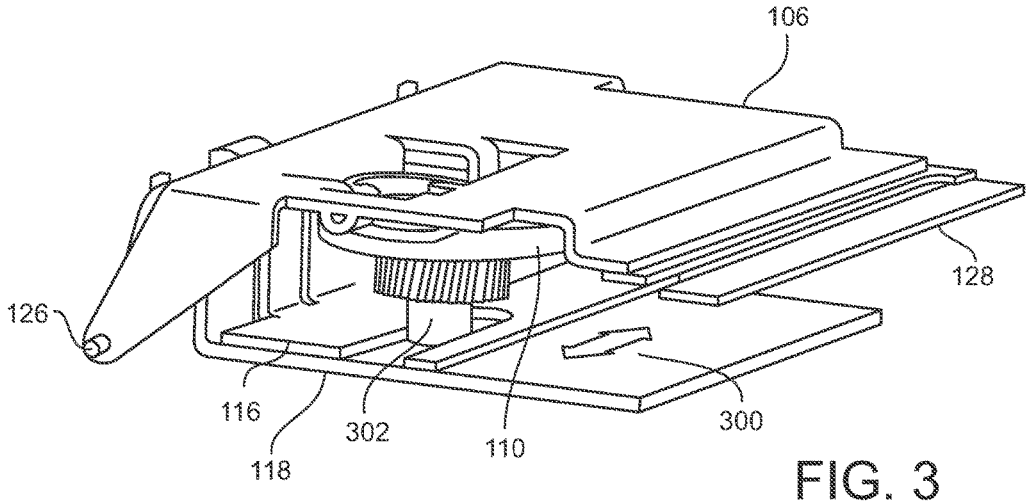
FIG. 3 illustrates a top view of the paper cutting system shown in FIG. 2.

The system 100 includes a motor plate 116 attached to motor 102. The motor plate 116 and motor 102 may be attached by one or more fasteners (not shown). Continuing this example with reference to FIG. 2, the figure shows that motor plate 116 is configured to move a distance bi-directionally as illustrated by arrow 200 on base 118. In accordance with embodiments, the motor plate may be configured to move in the directions of arrow 200 when the motor operates in one of the first and second direction. In accordance with embodiments, motor plate 116 is configured to move in the direction of arrow 200 on the base by sliding across the base 118. Now referring to FIG. 3, the figure shows that motor plate 116 can slide the distance depicted by double arrow 300 across base 118 when motor 102 (not shown) operates. For example, motor plate 116 may be configured to slide a distance of, but not limited to, 5 mm. FIG. 3 also depicts that cam 110 may include a support 302 affixed to base 118. In accordance with embodiments, support 302 may prevent motor plate 116 from traveling farther than required on base 118.

In accordance with embodiments, the system 100 may include a stabilizer bar 120 that is attached to motor plate 116 via collar 122. The stabilizer bar of the present disclosure may also be configured to be attached to the blade via another one or more collars. For example, FIG. 1 also illustrates stabilizer bar 120 is attached to blade 106 via collars 124 and 126. The blade 106 is configured to move bi-directionally as illustrated by arrow 200 along with motor plate 116 via attachment to stabilizer bar 120. In accordance with embodiments, the system 100 may include extension springs to secure the blade 106 to the motor plate 116 using spring forces. For example, FIG. 1 also illustrates spring forces 119 securing blade 106 to base 118.

Figure 4:
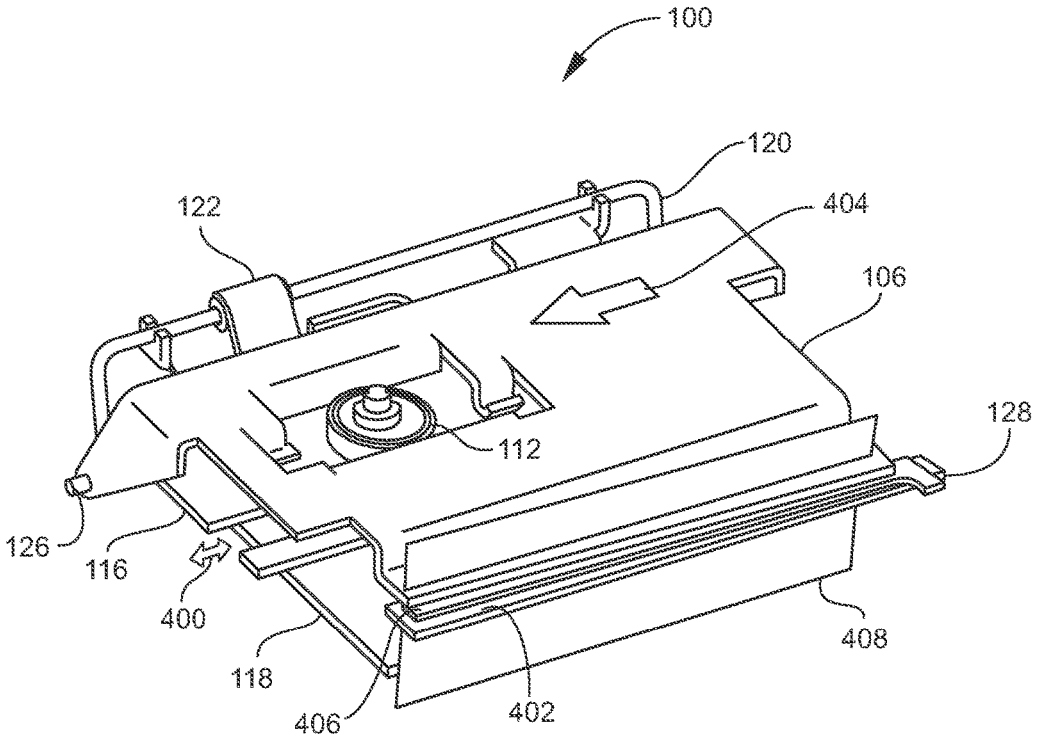
FIG. 4 illustrates a top perspective view the paper cutting system shown in FIGS. 1-3 performing a full cut of a paper in accordance with embodiments of the present disclosure.

The distance may also determine whether the blade performs the full cut or partial cut of the paper in accordance with embodiment of the present disclosure. For example, FIG. 4 depicts blade 106 performing a full cut of paper 408 as blade 106 moves in the direction of arrow 404 with motor plate 116. The figure also depicts motor plate 116 sliding in the direction of arrow 400 along base 118 a distance 400. Blade 106 includes a surface 406 configured to meet a surface 402 of stationary blade 128 to perform the full cut of paper 408. In accordance with embodiments, motor 102 is configured to maintain a first position of blade 106 to perform successive full cuts of paper 408. For example, motor 102 attached to motor plate 116 may be configured to maintain a first position of blade 106 as depicted in FIG. 4 to perform successive full cuts of paper 408.

Figure 5:
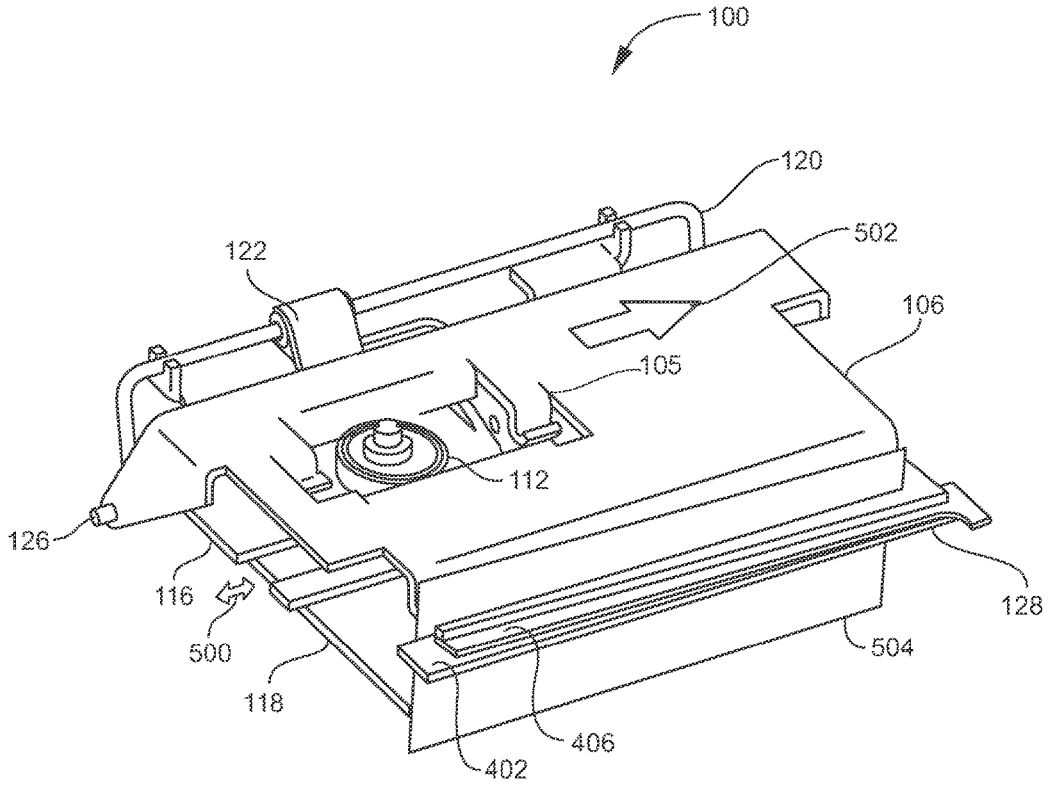
FIG. 5 illustrates a top perspective view of the paper cutting system shown in FIGS. 1-3 performing a partial cut of a paper in accordance with embodiments of the present disclosure.

In another example, FIG. 5 depicts blade 106 performing a partial cut of paper 504 as the blade 106 moves in a direction 502 with motor plate 116 in the direction 502. In this example, the figure also shows motor plate 116 sliding and moving along base 118 at a distance 500. The figure further shows blade 106 having a surface 406 that is configured to meet a surface 402 containing a stationary blade 128 in order to perform the partial cut of paper 504. In accordance with embodiments, motor 102 is configured to maintain a second position of blade 106 to perform successive partial cuts of paper 504. For example, motor 102 attached to motor plate 116 may be configured to maintain a second position of blade 106 as depicted in FIG. 5 to perform successive partial cuts of paper 408.

Figure 6:
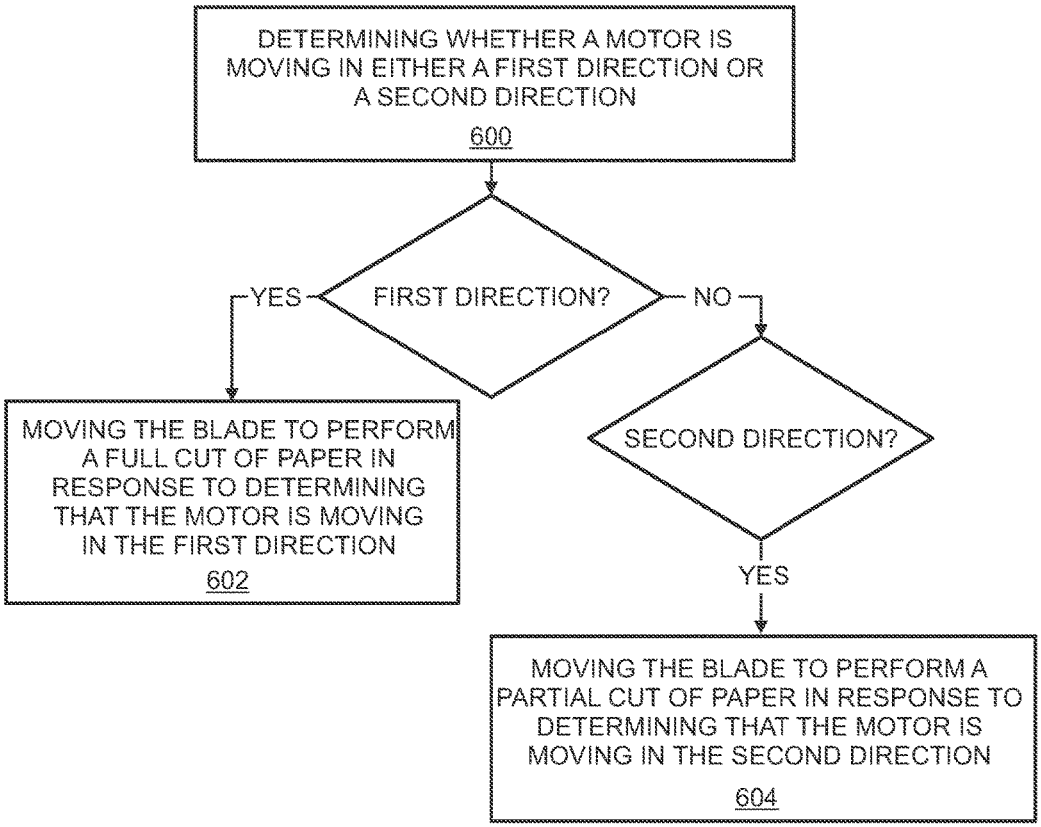
FIG. 6 illustrates a flow chart of an example method for performing a full cut of paper and a partial cut of paper in accordance with embodiments of the present disclosure.

FIG. 6 illustrates a flow chart of an example method for performing a full cut of paper and a partial cut of paper in accordance with embodiments of the present disclosure. Reference is made in this example to the system shown in FIGS. 1-5, but it should be understood the method can be implemented by any suitable system. As shown in FIG. 6, the method includes determining 600 whether a motor is moving in either a first direction or a second direction. For example, the paper cutting system of FIG. 1 may determine whether motor 102 is moving in either a first direction or a second direction. FIG. 6 includes moving 602 the blade to perform a full cut of paper in response to determining that the motor is moving in the first direction. Continuing the example, the paper cutting system of FIG. 1 may move blade 106 to perform a full cut of paper when the motor 102 is moves in first direction. Returning to FIG. 6, the method includes moving 604 the blade to perform a partial cut of paper when the motor moves in the second direction. For example, the paper cutting system of FIG. 1 is configured to move blade 106 to perform a partial cut of paper when the motor 102 moves in the second direction.

Figure 7:
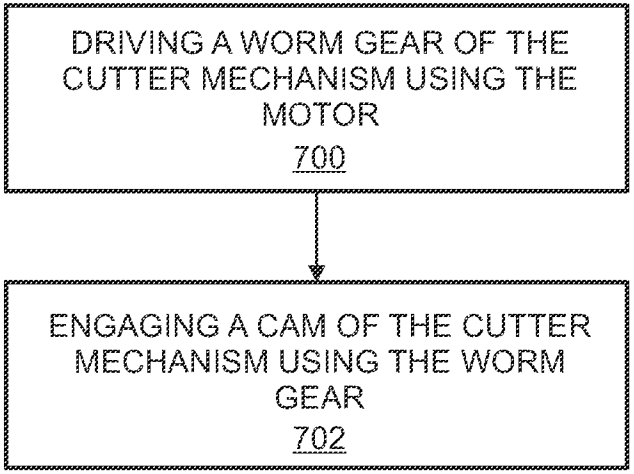
FIG. 7 illustrates a flow chart of an example method for driving a worm gear of a cutter mechanism using a motor in accordance with embodiments of the present disclosure.

FIG. 7 illustrates a flow chart of an example method for driving a worm gear of a cutter mechanism using a motor in accordance with embodiments of the present disclosure. Referring to FIG. 7, the method includes driving 700 a worm gear of the cutter mechanism using the motor. For example, the paper cutting system 100 of FIG. 1 may be configured to drive worm gear 108 of cutter mechanism 104 using motor 102. Returning to FIG. 7, the method may include engaging 702 a cam of the cutter mechanism using the worm gear. Continuing the example, the paper cutting system 100 of FIG. 1 is configured to engage cam 110 of cutter mechanism 104 using worm gear 108.

Figure 8:
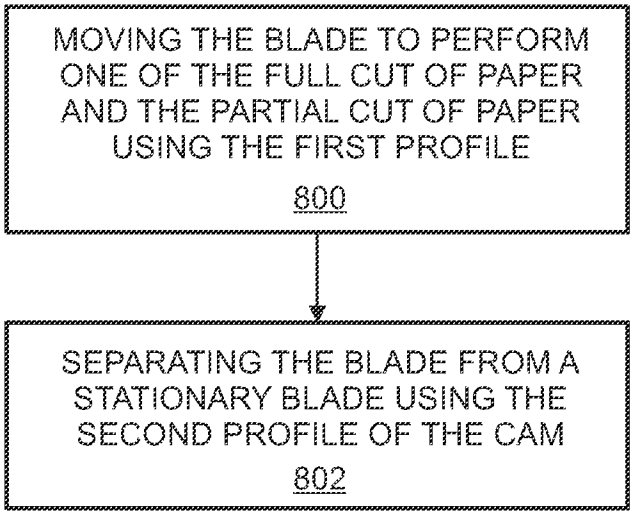
FIG. 8 illustrates a flow chart of an example method for moving the blade to perform one of the full cut of paper and the partial cut of paper using a first profile in accordance with embodiments of the present disclosure.

FIG. 8 illustrates a flow chart of an example method moving the blade to perform one of the full cut of paper and the partial cut of paper using a first profile in accordance with embodiments of the present disclosure. Referring to FIG. 8, the method includes moving 800 the blade to perform one of the full cut of paper and the partial cut of paper using a first profile of the cam. For example, the paper cutting system 100 of FIG. 1 is configured to move blade 106 to perform one of the full cut of paper and the partial cut of paper using a first profile 112 of cam 110. Returning to FIG. 8, the method includes separating 802 the blade from a stationary blade using a second profile of the cam. Continuing the example, the paper cutting system 100 of FIG. 1 may separate blade 106 from stationary blade 128 using second profile 114 of cam 110. In accordance with embodiments, the second profile may be configured to separate the blade from the stationary blade by lifting the blade away from the stationary blade. The second profile 114 may contact the curved member 105 located at the bottom of the blade 106 in order to separate the blade 106, as shown in FIG. 1 and FIG. 5.

Figure 9:
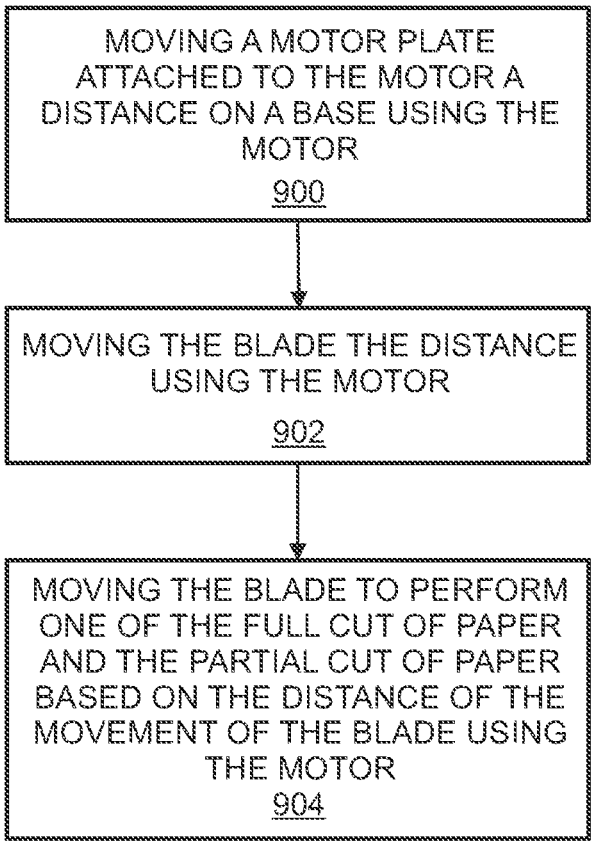
FIG. 9 illustrates a flow chart of an example method for moving a motor plate attached to the motor a distance on a base using the motor in accordance with embodiments of the present disclosure.

In accordance with embodiments, FIG. 9 illustrates a flow chart of an example method for moving a motor plate attached to the motor a distance on a base using the motor in accordance with embodiments of the present disclosure. The method includes moving 900 a motor plate attached to the motor a distance on a base using the motor. For example, the paper cutting system 100 of FIG. 2 may move motor plate 116 attached to motor 102 (not shown) a distance 200 on base 118 using motor 102. Returning to FIG. 9, the method includes moving 902 the blade the distance using the motor. Continuing the example, the paper cutting system 100 of FIG. 2 may move blade 106 distance 200 using motor 102.

Returning to FIG. 9, the method includes moving 904 the blade to perform one of the full cut of paper and the partial cut of paper based on the distance of the movement of the blade using the motor. For example, the paper cutting system 100 of FIG. 4 may move blade 106 to perform the full cut of paper 406 based on the distance 400 of the movement 404 of blade 106 using motor 102 (not shown). In another example, the system 100 of FIG. 5 may move blade 106 to perform the partial cut of paper 504 based on the distance 500 of the movement 502 of blade 106 using motor 102 (not shown).

Figure 10:
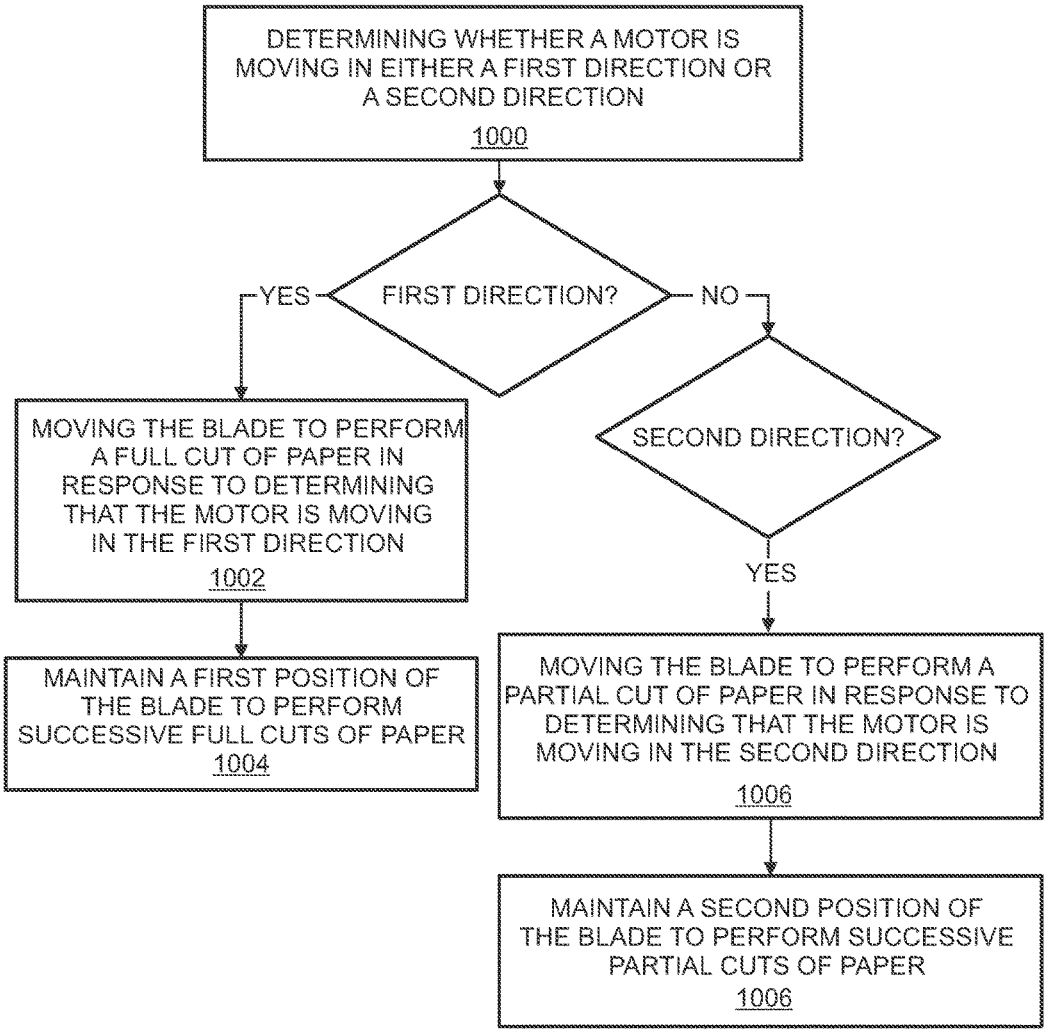
FIG. 10 illustrates a flow chart of an example method for maintaining a position of the blade to perform successive cuts of paper in accordance with embodiments of the present disclosure.

In accordance with embodiments, FIG. 10 illustrates a flow chart of an example method for maintaining one of a first and second position of the blade to perform one of successive full cuts and partial cuts of paper. The method includes determining 1000 whether a motor is moving in either a first direction or a second direction as shown in FIG. 10. For example, the paper cutting system 100 of FIG. 1 may determine whether motor 102 is moving in either a first direction or a second direction. Returning to FIG. 10, the method may also include moving 1002 the blade to perform a full cut of paper in response to determining that the motor is moving in the first direction. For example, FIG. 4 illustrates paper cutting system 100 may move blade 106 to perform a full cut of paper in response to determining that motor 102 is moving in direction 404. FIG. 10 also illustrates the method may include maintaining 1004 a first position of the blade to perform successive full cuts of paper. For example, FIG. 4 illustrates paper cutting system 100 may maintain a first position of blade 106 as shown in FIG. 4 to perform successive full cuts of paper 408.

Returning to FIG. 10, the method may also include moving 1006 the blade to perform a partial cut of paper in response to determining that the motor is moving in the second direction. For example, FIG. 5 illustrates paper cutting system 100 may move blade 106 to perform a full cut of paper in response to determining that motor 102 is moving in direction 502. FIG. 10 also illustrates the method may include maintaining 1006 a second position of the blade to perform successive partial cuts of paper. For example, FIG. 5 illustrates paper cutting system 100 may maintain a first position of blade 106 as shown in FIG. 5 to perform successive full cuts of paper 504.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present subject matter. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While certain embodiments have been described, these embodiments have been presented by way of example only, and are not intended to limit the scope of the presently disclosed subject matter. Indeed, the novel methods, devices, and systems described herein may be embodied in a variety of other forms. Furthermore, various omissions, substitutions, and changes in the form of the methods, devices, and systems described herein may be made without departing from the spirit of the presently disclosed subject matter. The accompanying claims and their equivalents are intended to cover such forms or modifications as would fall within the scope and spirit of the presently disclosed subject matter.

What is claimed:

1. A paper cutter system comprising:

a motor operable to move in either a first direction or a second direction;

a movable blade; and a cutter mechanism configured to:

move the blade to perform a full cut of paper when the motor moves in the first direction; and move the blade to perform a partial cut of paper when the motor moves in the second direction.

2. The paper cutter system of claim 1, wherein the cutter mechanism comprises:

a worm gear configured to be driven by the motor; and a cam configured to be engaged by the worm gear.

3. The paper cutter system of claim 2, wherein the cam comprises:

a first profile configured to drive the blade; and a second profile configured to separate the blade from a stationary blade.

4. The paper cutter system of claim 1, wherein the cutter mechanism comprises:

a motor plate attached to the motor by at least one fastener and configured to move a distance on a base.

5. The paper cutter system of claim 4, wherein the cutter mechanism comprises a stabilizer bar configured to be attached to the motor plate via one or more collars.

6. The paper cutter system of claim 5, wherein the stabilizer bar is also configured to be attached to the blade via another one or more collars.

7. The paper cutter system of claim 4, wherein the blade is configured to move the distance along with motor plate.

8. The paper cutter system of claim 7, wherein the distance determines whether the blade performs the full cut or the partial cut of the paper.

9. The paper cutter system of claim 1, wherein the motor is configured to maintain a first position of the blade to perform successive full cuts of paper.

10. The paper cutter system of claim 1, wherein the motor is configured to maintain a second position of the blade to perform successive partial cuts of paper.

* * * * *